US011104473B2

(12) United States Patent
Collins

(10) Patent No.: US 11,104,473 B2
(45) Date of Patent: Aug. 31, 2021

(54) PACKAGING FOR AT LEAST ONE ELECTRONIC SMOKING DEVICE PRODUCT

(71) Applicant: Fontem Holdings 1 B.V., Amsterdam (NL)

(72) Inventor: Fiona Collins, Hamburg (DE)

(73) Assignee: Fontem Holdings 1 B.V., Amsterdam (NL)

( * ) Notice: Subject to any disclaimer, the term of this patent is extended or adjusted under 35 U.S.C. 154(b) by 205 days.

(21) Appl. No.: 16/065,290

(22) PCT Filed: Dec. 6, 2016

(86) PCT No.: PCT/EP2016/079918
§ 371 (c)(1),
(2) Date: Jun. 22, 2018

(87) PCT Pub. No.: WO2017/108392
PCT Pub. Date: Jun. 29, 2017

(65) Prior Publication Data

US 2020/0172284 A1 Jun. 4, 2020

(30) Foreign Application Priority Data

Dec. 23, 2015 (EP) ..... 15202430

(51) Int. Cl.
*B65D 5/50* (2006.01)
*B65D 5/00* (2006.01)
(Continued)

(52) U.S. Cl.
CPC ..... *B65D 5/009* (2013.01); *A24F 40/70* (2020.01); *B65D 85/1063* (2013.01); *B65D 2585/86* (2013.01)

(58) Field of Classification Search
CPC ..... B65D 5/009; B65D 5/0085; B65D 5/44; B65D 5/32; B65D 85/1063;
(Continued)

(56) References Cited

U.S. PATENT DOCUMENTS 2,126,407 A * 8/1938 Payne ..... B65D 5/0085 206/750
5,344,008 A 9/1994 DeBlasio et al.
(Continued)

FOREIGN PATENT DOCUMENTS

CA 2547004 A1 * 6/2005 ..... B65B 19/20
CN 2496771 Y 6/2002
(Continued)

OTHER PUBLICATIONS

WO_8808602_translation.pdf accessed Jul. 27, 2020.*
Chinese Notification of the First Office Action (CN 201680076263.8) dated May 8, 2019 (13 pages).

*Primary Examiner* — Allan D Stevens
(74) *Attorney, Agent, or Firm* — Dykema Gossett PLLC

(57) ABSTRACT

The invention relates to a packaging (1) for at least one electronic smoking device product, the packaging comprising a back panel (2) and at least two packaging layers (3, 4, 5), wherein the back panel (2) comprises a first back panel portion (2*a*) and a second back panel portion (2*b*), wherein the first and second back panel portions (2*a*, 2*b*) are pivotable relative to each other, wherein the at least two packaging layers (3, 4, 5) comprise a first packaging layer (3) and a second packaging layer (4), wherein the first packaging layer (3) is connected to the first back panel portion (2*a*) and wherein the second packaging layer (4) is connected to the second back panel portion (2*b*).

13 Claims, 5 Drawing Sheets

(51) Int. Cl.
*A24F 40/70* (2020.01)
*B65D 85/10* (2006.01)

(58) Field of Classification Search
CPC .. B65D 85/1072; B65D 5/256; B65D 5/2566; B65D 5/2553; B65D 5/526; B65D 5/5266; B65D 5/5253; B25H 3/023; G01F 1/06
USPC ..... 206/745, 747, 748, 749; 229/120.09
See application file for complete search history.

(56) References Cited

U.S. PATENT DOCUMENTS 5,346,091 A * 9/1994 Hsu ..... B25H 3/023 206/503
5,370,255 A * 12/1994 Yang ..... A45C 7/00 220/4.22
6,003,708 A * 12/1999 Meyering ..... B65D 1/225 220/520
6,026,973 A * 2/2000 Der Kinderen ..... B25H 3/023 206/372
6,220,443 B1 * 4/2001 Damaskos ..... B65D 5/0085 206/315.9
D784,807 S * 4/2017 Glass ..... D9/432
2010/0139676 A1 * 6/2010 Yanchev ..... B65D 85/1063 131/329

FOREIGN PATENT DOCUMENTS

| | | | | |
|---|---|---|---|---|
| CN | 201354216 | Y | 12/2009 | |
| CN | 201825311 | U | 5/2011 | |
| CN | 201961617 | U | 9/2011 | |
| CN | 203652231 | U | 6/2014 | |
| CN | 203903158 | U | 10/2014 | |
| CN | 104494992 | A | 4/2015 | |
| CN | 204415943 | U | 6/2015 | |
| CN | 204861187 | U | 12/2015 | |
| EP | 1048576 | A1 * | 11/2000 | ..... B65D 5/009 |
| EP | 2210817 | A1 * | 7/2010 | ..... B65D 5/36 |
| FR | 791882 | A * | 12/1935 | ..... B65D 5/009 |
| WO | 88/08602 | A1 | 11/1988 | |
| WO | 2014/141131 | A1 | 9/2014 | |
| WO | WO-2016057380 | A1 * | 4/2016 | ..... B65D 5/5495 |

* cited by examiner

PACKAGING FOR AT LEAST ONE ELECTRONIC SMOKING DEVICE PRODUCT

FIELD OF INVENTION

The present invention relates generally to electronic smoking devices and in particular electronic cigarettes.

BACKGROUND OF THE INVENTION

An electronic smoking device, such as an electronic cigarette (e-cigarette), typically has a housing accommodating an electric power source (e.g. a single use or rechargeable battery, electrical plug, or other power source), and an electrically operable atomizer. The atomizer vaporizes or atomizes liquid supplied from a reservoir and provides vaporized or atomized liquid as an aerosol. Control electronics control the activation of the atomizer. In some electronic cigarettes, an airflow sensor is provided within the electronic smoking device, which detects a user puffing on the device (e.g., by sensing an under-pressure or an air flow pattern through the device). The airflow sensor indicates or signals the puff to the control electronics to power up the device and generate vapor. In other e-cigarettes, a switch is used to power up the e-cigarette to generate a puff of vapor.

A variety of products may be used as accessories or components for an electronic smoking device. These electronic smoking device components or accessories may be incompatible for use with an electronic smoking device of another vendor. In addition, the users may be challenged by keeping the single pieces together. This may lead to inconvenient situations for the users of electronic smoking devices who desire to obtain components and accessories for a specific electronic smoking device.

SUMMARY OF THE INVENTION

In accordance with one aspect of the present invention there is provided a packaging for at least one electronic smoking device product. The packaging comprises a back panel and at least two packaging layers. The back panel comprises a first back panel portion and a second back panel portion, wherein the first and second back panel portions are pivotable relative to each other. The at least two packaging layers comprise a first packaging layer and a second packaging layer, wherein the first packaging layer is connected to the first back panel portion, and the second packaging layer is connected to the second back panel portion.

The characteristics, features and advantages of this invention and the manner in which they are obtained as described above, will become more apparent and be more clearly understood in connection with the following description of exemplary embodiments, which are explained with reference to the accompanying drawings.

BRIEF DESCRIPTION OF THE DRAWINGS

In the drawings, same element numbers indicate same elements in each of the views.

DESCRIPTION OF THE PREFERRED EMBODIMENTS

Throughout the following, a packaging, an electronic smoking device, as well as components and accessories for the electronic smoking device (electronic smoking device products) are described with reference to the drawings. One or more of at least one of an electronic smoking device, a component thereof, and an accessory for the electronic smoking device may be packaged within a packaging according to exemplary embodiments of the invention. The electronic smoking device is hereinafter described with reference to an e-cigarette.

Figure 1:
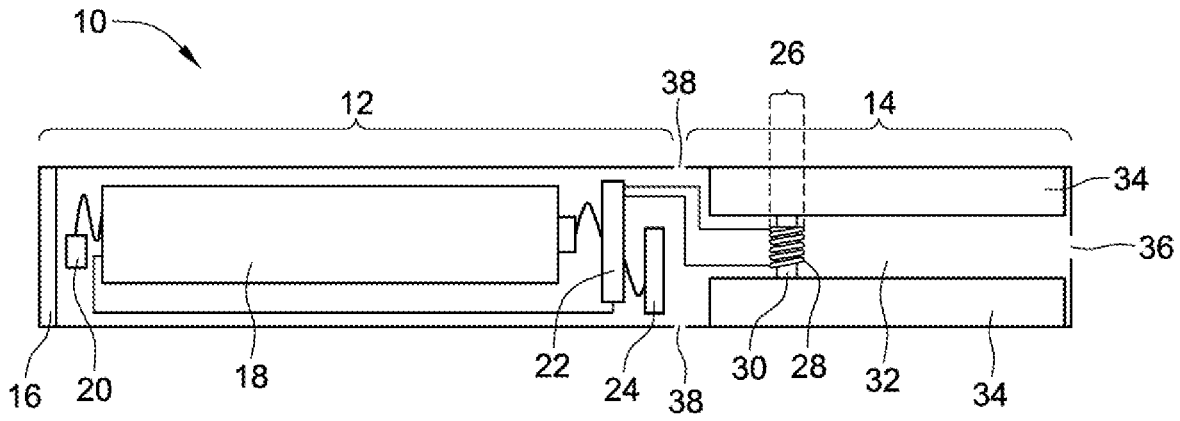
FIG. 1 is a schematic cross-sectional illustration of an exemplary electronic smoking device.

As is shown in FIG. 1, the e-cigarette 10 typically has a housing comprising a cylindrical hollow tube having an end cap 16. The cylindrical hollow tube may be a single-piece or a multiple-piece tube. In FIG. 1, the cylindrical hollow tube is shown as a two-piece structure having a power supply portion 12 and an atomizer/liquid reservoir portion 14. Together the power supply portion 12 and the atomizer/liquid reservoir portion 14 form a cylindrical tube which can be approximately the same size and shape as a conventional cigarette, typically about 100 mm with a 7.5 mm diameter, although lengths may range from 70 to 150 or 180 mm, and diameters from 5 to 20 mm.

The power supply portion 12 and atomizer/liquid reservoir portion 14 are typically made of metal, e.g. steel or aluminum, or of hardwearing plastic and act together with the end cap 16 to provide a housing to contain the components of the e-cigarette 10. The power supply portion 12 and an atomizer/liquid reservoir portion 14 may be configured to fit together by a friction push fit, a snap fit, or a bayonet attachment, magnetic fit, or screw threads. The end cap 16 is provided at the front end of the power supply portion 12. The end cap 16 may be made from translucent plastic or other translucent material to allow an light-emitting diode (LED) 20 positioned near the end cap to emit light through the end cap. The end cap can be made of metal or other materials that do not allow light to pass.

An air inlet may be provided in the end cap, at the edge of the inlet next to the cylindrical hollow tube, anywhere along the length of the cylindrical hollow tube, or at the connection of the power supply portion 12 and the atomizer/liquid reservoir portion 14. FIG. 1 shows a pair of air inlets 38 provided at the intersection between the power supply portion 12 and the atomizer/liquid reservoir portion 14.

A power supply, preferably a battery 18, a light-emitting diode (LED) 20, control electronics 22 and optionally an airflow sensor 24 are provided within the cylindrical hollow tube power supply portion 12. The battery 18 is electrically connected to the control electronics 22, which are electrically connected to the LED 20 and the airflow sensor 24. In this example the LED 20 is at the front end of the power supply portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure, such as a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer 26 and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil.

The central passage 32 is surrounded by a cylindrical liquid reservoir 34 with the ends of the wick 30 abutting or extending into the liquid reservoir 34. The wick 30 may be a porous material such as a bundle of fiberglass fibers, with liquid in the liquid reservoir 34 drawn by capillary action from the ends of the wick 30 towards the central portion of the wick 30 encircled by the heating coil 28.

The liquid reservoir 34 may alternatively include wadding soaked in liquid which encircles the central passage 32 with the ends of the wick 30 abutting the wadding. In other embodiments the liquid reservoir 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed from the cylindrical hollow tube atomizer/liquid reservoir portion 14 or maybe formed in an end cap.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure which arises is detected by the airflow sensor 24, which generates an electrical signal that is passed to the control electronics 22. In response to the signal, the control electronics 22 activate the heating coil 28, which causes liquid present in the wick 30 to be vaporized creating an aerosol (which may comprise gaseous and liquid components) within the central passage 32. As the user continues to suck on the e-cigarette 10, this aerosol is drawn through the central passage 32 and inhaled by the user. At the same time the control electronics 22 also activate the LED 20 causing the LED 20 to light up which is visible via the translucent end cap 16 mimicking the appearance of a glowing ember at the end of a conventional cigarette. As liquid present in the wick 30 is converted into an aerosol more liquid is drawn into the wick 30 from the liquid reservoir 34 by capillary action and thus is available to be converted into an aerosol through subsequent activation of the heating coil 28.

Some e-cigarette are intended to be disposable and the electric power in the battery 18 is intended to be sufficient to vaporize the liquid contained within the liquid reservoir 34, after which the e-cigarette 10 is thrown away. In other embodiments the battery 18 is rechargeable and the liquid reservoir 34 is refillable. In the cases where the liquid reservoir 34 is a toroidal cavity, this may be achieved by refilling the liquid reservoir 34 via a refill port. In other embodiments the atomizer/liquid reservoir portion 14 of the e-cigarette 10 is detachable from the power supply portion 12 and a new atomizer/liquid reservoir portion 14 can be fitted with a new liquid reservoir 34 thereby replenishing the supply of liquid. In some cases, replacing the liquid reservoir 34 may involve replacement of the heating coil 28 and the wick 30 along with the replacement of the liquid reservoir 34. A replaceable unit comprising the atomizer 26 and the liquid reservoir 34 is called a cartomizer.

The new liquid reservoir 34 may be in the form of a cartridge having a central passage 32 through which a user inhales aerosol. In other embodiments, aerosol may flow around the exterior of the cartridge 32 to an air inhalation port 36.

Of course, in addition to the above description of the structure and function of a typical e-cigarette 10, variations also exist. For example, the LED 20 may be omitted. The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design aerosol is generated by evaporating the liquid within the porous body either by activation of the coil heating the porous body or alternatively by the heated air passing over or through the porous body. Alternatively the atomizer may use a piezoelectric atomizer to create an aerosol either in combination or in the absence of a heater.

Figure 2:
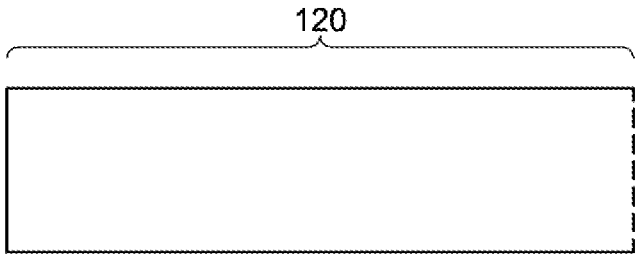
FIGS. 2 to 5 are schematic illustrations of exemplary electronic smoking device products.
Figure 3:
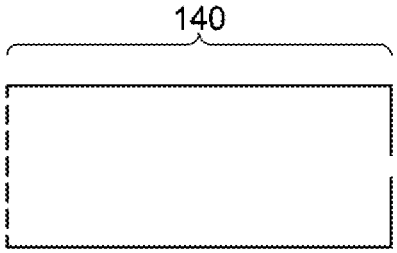

In FIG. 2, an exemplary electronic smoking device product is illustrated schematically, wherein the electronic smoking device product is a component for an electronic smoking device. The electronic smoking device product shown in FIG. 2 is a power supply portion 120 being adapted to be reversibly attachable to at least one other component of an electronic smoking device to form the assembled electronic smoking device. For example, the power supply portion 120 is adapted to be attached to an atomizer/liquid reservoir portion 140 which is shown in FIG. 3. The power supply portion 120 shown in FIG. 2 has a longitudinal shape.

In FIG. 3, an exemplary electronic smoking device product is illustrated schematically, wherein the electronic smoking device product is a component for an electronic smoking device. The electronic smoking device product shown in FIG. 3 is an atomizer/liquid reservoir portion 140 being adapted to be reversibly attachable to at least one other component of an electronic smoking device to form the assembled electronic smoking device. For example, the atomizer/liquid reservoir portion 140 is adapted to be attached to the power supply portion 120 shown in FIG. 2. The atomizer/liquid reservoir portion 140 shown in FIG. 3 has a longitudinal shape.

Figure 4:
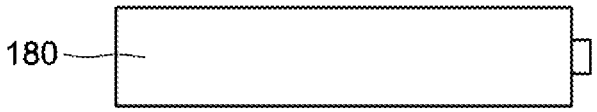

In FIG. 4, an exemplary electronic smoking device product is illustrated schematically, wherein the electronic smoking device product is a component for an electronic smoking device and/or a portion thereof. For example the electronic smoking device product is a component for the power supply portion 12 of the electronic smoking device (e.g., e-cigarette 10) shown in FIG. 1 or a component for the power supply portion 120 shown in FIG. 2. The electronic smoking device product shown in FIG. 4 is a battery 180 for insertion into the power supply portion 12 of the electronic smoking device (e.g., e-cigarette 10) or the power supply portion 120. The battery 180 shown in FIG. 4 has a longitudinal shape.

Figure 5A:
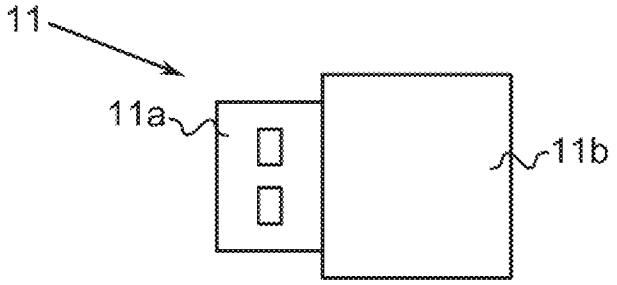
Figure 5B:
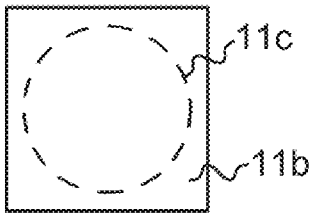

In FIG. 5, an exemplary electronic smoking device product is illustrated schematically, wherein the electronic smoking device product is an accessory for an electronic smoking device or a component thereof. The electronic smoking device product shown in FIG. 5 is a charging device 11 adapted to be reversibly attachable to at least one of an electronic smoking device (e.g., e-cigarette 10) and the power supply portion 120 and other components suitable to be charged by the charging device. The charging device 11 may be adapted to charge the battery 18, 180 upon electrically connecting the electronic smoking device or the power supply portion to the charging device 11. The charging device 11 may be a Universal Serial Bus (USB) charging device having a first portion 11*a*, in particular a USB connector or plug, and a second portion 11*b*. The second portion 11*b* may include a coupling element 11*c* for coupling to the electronic smoking device, the power supply portion 120 or other components for the transfer of energy and/or data. The charging device 11 shown in FIG. 5 has a cuboid shape, but may have other shapes as well. For example, the charging device 11 may have a longitudinal shape. The coupling element 11*c* is shown to be arranged at an end portion opposite to the USB plug 11*a*, but may be arranged at another position as well.

Figure 6:
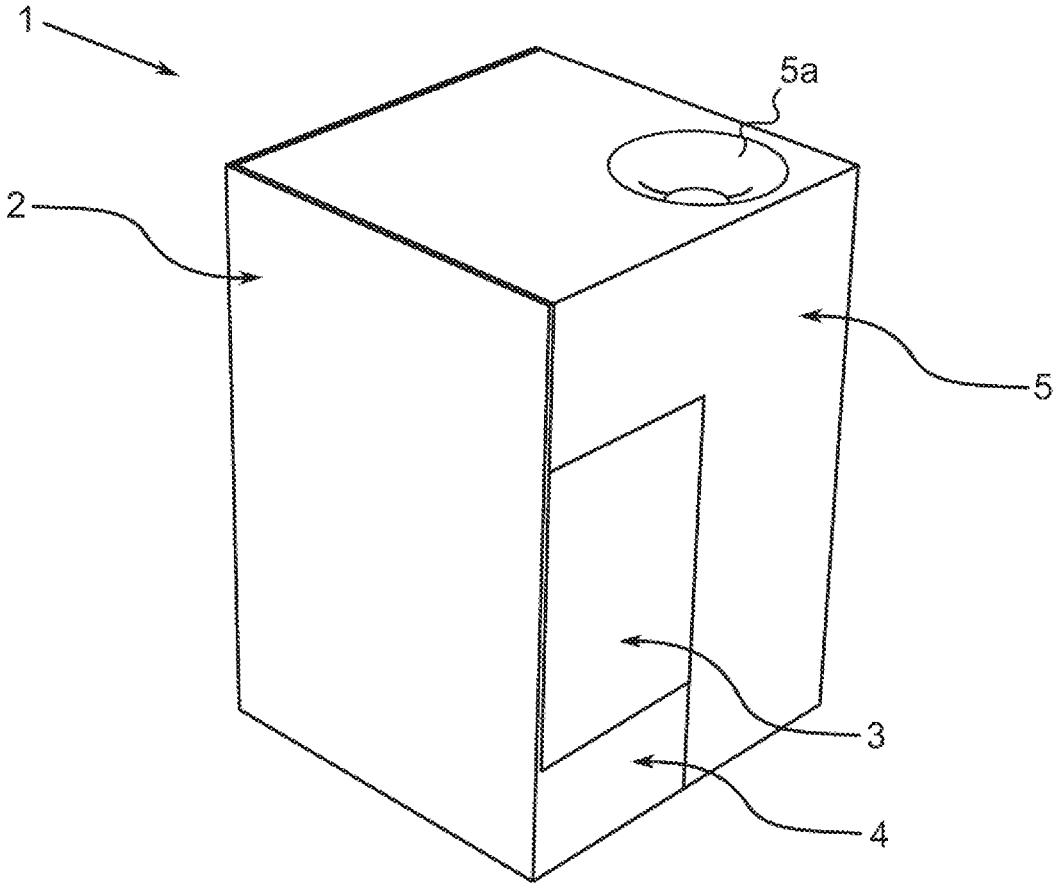
FIG. 6 is a schematic perspective view of an exemplary packaging according to an embodiment of the present invention, wherein the packaging is shown in a closed position.

In FIG. 6, an exemplary packaging according to an embodiment of the present invention is schematically illustrated in a perspective view, wherein the packaging is shown in a closed position.

The packaging 1 for at least one electronic smoking device product (e.g., charging device 11, atomizer/liquid reservoir portion 14, battery 18) comprises a back panel 2. The back panel 2 may form an outer surface of the packaging 1 when the packaging 1 is in a closed position.

The packaging 1 for at least one electronic smoking device product comprises at least two packaging layers 3, 4, 5. The packaging layers 3, 4, 5 may be adapted to receive one or more of the at least one electronic smoking device products. As shown, the at least two packaging layers 3, 4, 5 include a first packaging layer 3, a second packaging layer 4, and a third packaging layers 5. The packaging 1 may alternatively be adapted to comprise only two or even more than three packaging layers as well. Each of the at least two packaging layers 3, 4, 5 may include one or more receptacles 3*a*, 4*a* each of which may be adapted to house an electronic smoking device product as will be described in greater detail below.

The electronic smoking device product packaged by the packaging 1 may be any one of at least one of an electronic smoking device component (e.g., e-cigarette 10, power supply portion 12, atomizer/liquid reservoir portion 14, atomizer/liquid reservoir portion 140, battery 18, battery 180) and an accessory (e.g., charging device 11) for an electronic smoking device or a component thereof. Examples of electronic smoking device products to be packaged by the packaging 1 are illustrated in FIGS. 1 to 5. For example, the electronic smoking device product may include a first, a second and a third electronic smoking device product. The first electronic smoking device product may be a component for an electronic smoking device, for example an atomizer/liquid reservoir portion. The second electronic smoking device product may be an accessory for an electronic smoking device, for example the charging device 11. The third electronic smoking device product may be a component for an electronic smoking device, for example a battery 18, 180. The at least one electronic smoking device product may include a power supply portion 12, 120, a mouth piece, the electronic smoking device (e.g., e-cigarette 10) or any other component or accessory for an electronic smoking device. The packaging 1 may even be adapted to package only specific electronic smoking device products. This means, the packaging may be adapted to package only electronic smoking device products of a specific vendor.

The packaging 1 is herein illustrated in a closed position. The packaging 1 is adapted to be adjustable between an open position and a closed position such that the at least one electronic smoking device product can be packaged and unpackaged by adjusting the packaging 1 between the open and closed positions.

The system for packaging the at least one electronic smoking device product comprises the at least one electronic smoking device product (e.g., charging device 11, atomizer/liquid reservoir portion 14, battery 18) and a packaging 1 according to an embodiment of the present invention, wherein the at least one electronic smoking device product fits into the packaging 1 when the packaging 1 is in the closed position. Thus, the packaging 1 and the at least one smoking device product of the system are both adapted such that the at least one smoking device product can be packaged by the packaging 1.

Optionally, the packaging 1 may comprise a locking element to lock the packaging in a closed position. The locking element may comprise a friction push fit, a snap fit, or a bayonet attachment, magnetic fit, or any other locking elements which may be unlocked by a user.

The illustrated packaging 1 has a cuboidal shape when the packaging 1 is in the closed position. Alternatively, the packaging may be adapted to have another shape in the closed position. Optionally, the packaging 1 may have a mass distribution so as to provide a self-alignment functionality to keep or return the packaging 1 (by way of a restoring force) into an upright position (rest position) after the packaging 1 has been deflected from the upright position. The packaging or a portion thereof may alternatively have a spheroid shape, in particular the shape of a sphere. For example, a bottom portion of the packaging may have a round shape such as to self-align the packaging into an upright position. To this end, the packaging may be adapted such that the center of mass of the packaging is located in a bottom section of the packaging, wherein the bottom section is an end-section at the bottom of the packaging and extends across less than one half, preferred less than one third, more preferred less than one quarter of the largest extension of the packaging parallel to an upright direction.

Figure 7:
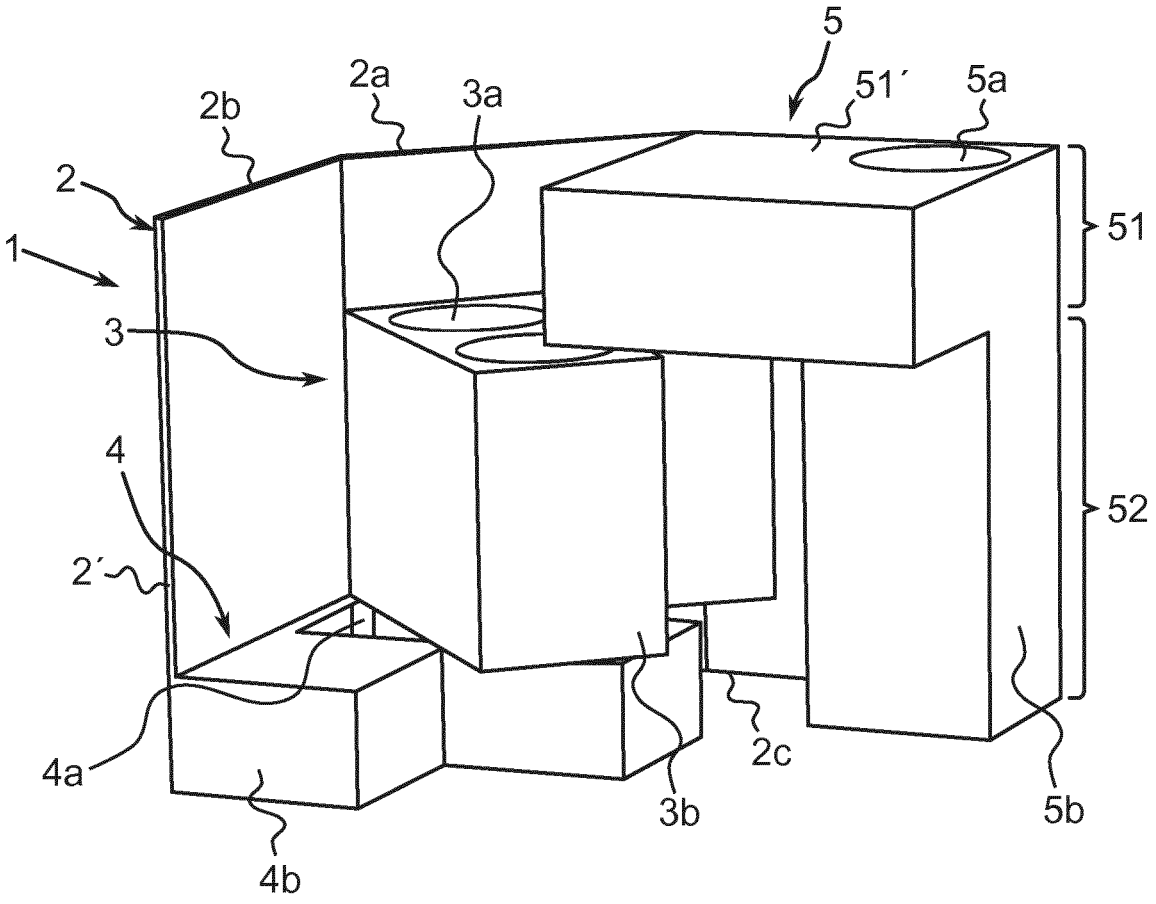
FIG. 7 is a schematic perspective view of an exemplary packaging according to an embodiment of the present invention, wherein the packaging is shown during adjustment between the closed position and an open position.
Figure 8:
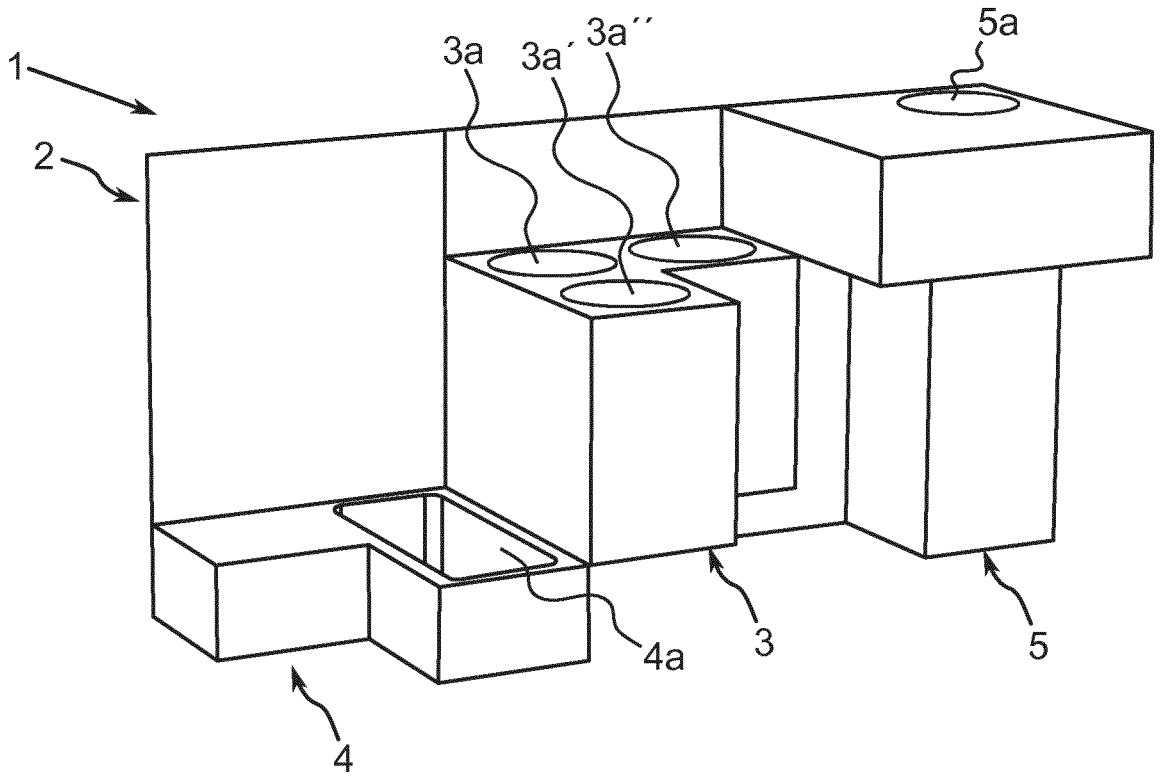
FIG. 8 is a schematic perspective view of an exemplary packaging according to an embodiment of the present invention, wherein the packaging is shown in the open position.

In FIG. 7, an exemplary packaging according to an embodiment of the present invention is schematically illustrated in a perspective view, wherein the packaging is shown during adjustment between the closed position (see FIG. 6) and an open position (see FIG. 8).

The back panel 2 comprises at least a first back panel portion 2*a* and a second back panel portion 2*b*. As shown, the back panel 2 comprises a third back panel portion 2*c*, wherein at least three outer surfaces of the packaging are formed by the three back panel portions 2*a*, 2*b*, 2*c* when the packaging 1 is in the closed position.

The first and second back panel portions 2*a*, 2*b* are pivotable relative to each other. As shown, the third back panel portion 2*c* is also pivotable relative to the first back panel portion 2*a*. In this document, the term "pivotable relative to", may refer to any type of arrangement that allows two portions to be pivotable relative to each other. For example, two portions that are pivotable relative to each other may be pivotable around a common axis. The two portions being pivotable relative to each other may be pivotably connected to each other. For example, the two portions may be pivoted relative to each other by folding or unfolding the two portions. Alternatively, a rigid element may extend along the common axis, wherein the two portions are connected to the rigid element, for example via at least one hinge, such that the two portions may be pivoted relative to each other.

One of the three back panel portions 2*a*, 2*b*, 2*c* may alternatively be fixed relative to at least one other back panel portion. For example, the third back panel portion 2*c* may even be fixed relative to the first back panel portion 2*a*, but the packaging 1 is nevertheless adapted such that the at least one electronic smoking device product (e.g., charging device 11, atomizer/liquid reservoir portion 14, battery 18, 180) can be packaged and unpackaged by adjusting the packaging 1 between a closed position and an open position.

The at least two packaging layers 3, 4, 5 comprise at least the first packaging layer 3 and the second packaging layer 4, wherein the first packaging layer 3 is connected to the first back panel portion 2*a*, wherein the second packaging layer 4 is connected to the second back panel portion 2*b*. As shown, the at least two packaging layers 3, 4, 5 further comprise a third packaging layer 5, wherein the third packaging layer 5 is connected to the third pack panel portion 2*c*.

The first packaging layer 3 is fixedly connected to the first back panel portion 2*a*. The second packaging layer 4 is fixedly connected to the second back panel portion 2*b*. The third packaging layer 5 is fixedly connected to the third back panel portion 2*c*. That is, the first packaging layer 3 is immovable relative to the first back panel portion 2*a*, the second packaging layer 4 is immovable relative to the second back panel portion 2*b*, and the third packaging layer 5 is immovable relative to the third back panel portion 2*c*.

As can be seen in the Figure, each of the at least two packaging layers 3, 4, 5 may include one or more receptacles 3*a*, 4*a*, 5*a* each of which may be adapted to house an electronic smoking device product (e.g., charging device 11, atomizer/liquid reservoir portion 14, battery 18). Moreover, the at least two packaging layers 3, 4, 5 fit together when the packaging 1 is in the closed position. That is, the three dimensional shapes of the at least two packaging layers 3, 4, 5 are adapted to fit together when the packaging 1 is in the closes position. In other words, when the packaging is in the closed position, the at least two packaging layers 3, 4, 5 may engage in an interlocking manner.

In the open position, the one or more receptacles 3*a*, 4*a*, 5*a* are accessible for the at least one electronic smoking device product (e.g., charging device 11, atomizer/liquid reservoir portion 14, battery 18, 180) to be inserted into the respective receptacle 3*a*, 4*a*, 5*a*. In the closed position, the openings of the at least some or all of the one or more receptacles 3*a*, 4*a*, 5*a* are covered by the at least two packaging layers 3, 4, 5 for the at least one electronic smoking device product to be packaged within the respective receptacle 3*a*, 4*a*, 5*a* when the packaging 1 is in the closed position.

The second packaging layer 4 is a bottom packaging layer of the packaging 1. The third packaging layer 5 is a top packaging layer of the packaging 1. The first packaging layer is arranged between the second and third packaging layers 4, 5 when the packaging 1 is in the closed position.

Each of the at least two packaging layers 3, 4, 5 may have an L-shaped cross section. As can be seen in FIG. 7, the third packaging layer 5 has an upper portion 51 and a lower portion 52, wherein the upper portion extends over the first packaging layer 3 when the packaging 1 is in the closed position. The upper portion 51 covers a receptacle 3*a* (in this case all receptacles 3*a* 3*b*, 3*c*—see FIG. 8) of the first packaging layer 3 when the packaging 1 is in the closed position. That is, the third packaging layer 5 has the functionality of a lid for the receptacles 3*a* of the first packaging layer 3. Likewise, a bottom surface of the first receptacle 3 covers a receptacle 4*a* of the second packaging layer 2, thereby forming a lid for the receptacle 4*a* of the second packaging layer 2 when the packaging 1 is in the closed position. As can bee seen in the Figure, the third packaging layer 5 comprises a receptacle 5*a* disposed in a top surface 51' of the third packaging layer 5. The third surface 51' is also a top surface of the set of the at least two packaging layers 3, 4, 5, especially in the closed position. Therefore, the receptacle 5*a* disposed in the top surface 51' may either be uncovered or covered by other elements such as a lid portion 2*d* of the back panel 2 as will be described in greater detail below.

In use, the at least one electronic smoking device product (e.g., charging device 11, atomizer/liquid reservoir portion 14, battery 18, 180) is inserted into the respective packaging layer of the at least two packaging layers 3, 4, 5, of the packaging 1 when the packaging 1 is in the open position. Subsequently, when the back panel portions 2*a*, 2*b*, 2*c* are moved, for example by the action of a user, the at least two packaging layers 3, 4, 5—which are fixed to the back panel portions 2*a*, 2*b*, 2*c*—are also moved until the packaging 1 is in a closed position, wherein, in the closed position, the at least two packaging layers 3, 4, 5 are arranged such that they fit together.

The at least one electronic smoking device product which is packaged by the packaging 1 may be unpackaged and thereby removed from the respective packaging layer of the at least two packaging layers 3, 4, 5, of the packaging 1 when the packaging 1 is in the open position. Subsequently, when the back panel portions 2*a*, 2*b*, 2*c* are moved, for example by the action of a user, the at least two packaging layers 3, 4, 5—which are fixed to the back panel portions 2*a*, 2*b*, 2*c*—are also moved until the packaging 1 is in an open position, wherein, in the open position, the at least two packaging layers 3, 4, 5 are arranged such that the receptacle 3*a*, 4*a* are accessible.

The back panel 2 may further comprise a reinforcement element 2' being arranged between outer layers of the back panel 2. The reinforcement element 2' shown in FIG. 7 is disposed within the second back panel portion 2*b*. The reinforcement element 2' and the second packaging layer 4 may be one piece, or the reinforcement element 2' may be fixedly connected to the second packaging layer. Likewise, other reinforcement elements (not shown) may be disposed within the other back panel portions 2*a*, 2*c*, 2*d*, and may be connected to the respective packaging layers 3, 5.

In FIG. 8, an exemplary packaging according to an embodiment of the present invention is schematically illustrated in a perspective view, wherein the packaging is shown in the open position. The packaging 1 comprises at least one receptacle 3*a*, 3*a*', 3*a*", 4*a*, 5*a* adapted to house the at least one electronic smoking device product (e.g., charging device 11, atomizer/liquid reservoir portion 14, battery 18).

The first packaging layer 3 comprises at least one first receptacle 3*a*, 3*a*', 3*a*" of the at least one receptacle 3*a*, 3*a*', 3*a*", 4*a*, 5*a*. The packaging 1 is adapted to receive at least one first electronic smoking device product into the at least one first receptacle 3*a*, 3*a*', 3*a*" when the packaging 1 is in the open position. The at least one first receptacle 3*a*, 3*a*', 3*a*" has a longitudinal shape. The at least one first receptacle 3*a*, 3*a*', 3*a*" has an insertion opening being arranged at the end of the at least one first receptacle 3*a*, 3*a*', 3*a*". The at least one first receptacle 3*a*, 3*a*', 3*a*" is covered by the third packaging layer 5 when the packaging 1 is in the closed position. Thus, the insertion opening faces a bottom surface of the third packaging layer 5 when the packaging 1 is in the closed position. As shown, the at least one first receptacle 3*a*, 3*a*', 3*a*" comprises three receptacles each of which having a longitudinal shape. Each of the at least one first receptacle 3*a*, 3*a*', 3*a*" may be adapted to house an atomizer/liquid reservoir portion 14.

The second packaging layer 4 comprises at least one second receptacle 4*a* of the at least one receptacle 3*a*, 3*a*', 3*a*", 4*a*, 5*a*. The packaging 1 is adapted to receive at least one second electronic smoking device product (e.g., charging device 11) into the at least one second receptacle 4*a* when the packaging is in the open position. The at least one second receptacle 4*a* is covered by the first packaging layer 3 when the packaging 1 is in the closed position. The at least one second receptacle 4*a* has a longitudinal shape. The at least one second receptacle 4*a* has an insertion opening which mainly extends between the two ends of the at least one second receptacle 4*a*. The insertion opening of the at least one second receptacle 4*a* faces a bottom surface of the first packaging layer 3 when the packaging 1 is in the closed position. As shown, the at least one second receptacle 4*a* is one receptacle adapted to house a charging device 11, in particular a USB charging device 11.

The third packaging layer 5 comprises a third receptacle 5*a* of the at least one third receptacle 5*a*, 3*a*', 3*a*", 4*a*, 5*a*. As shown, the third packaging layer 5 comprises the top surface 51' of the at least two packaging layers 3, 4, 5 and the at least one third receptacle 5*a* disposed in the top surface 51'. The third receptacle 5*a* is adapted to house a battery 18, 180.

Figure 9:
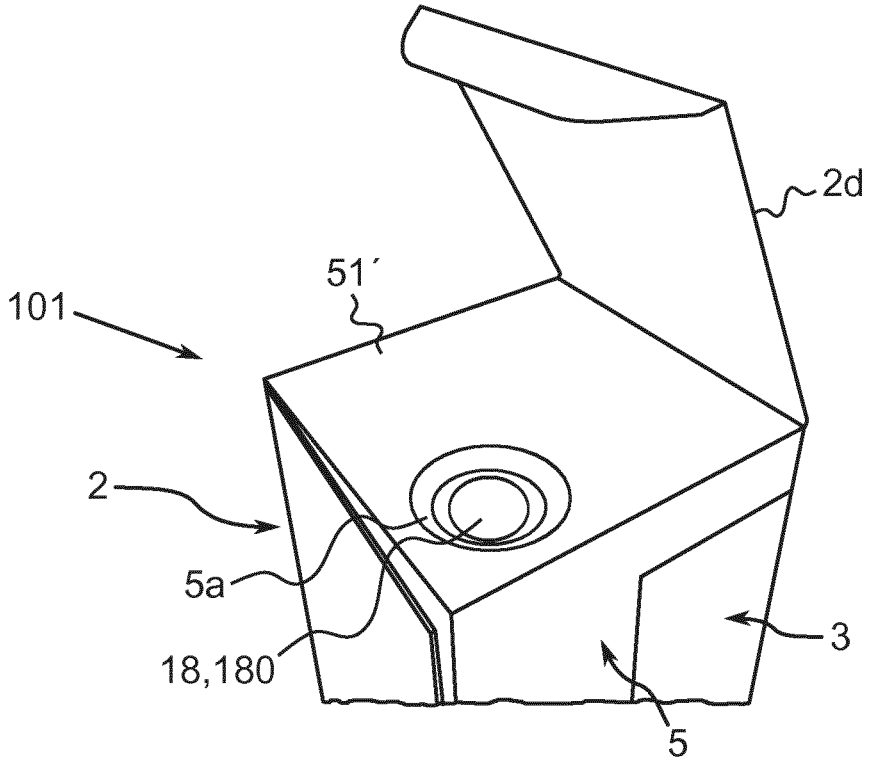
FIGS. 9 to 11 are schematic perspective views of an exemplary packaging according to an embodiment of the present invention, wherein the packaging comprises a lid portion.
Figure 10:
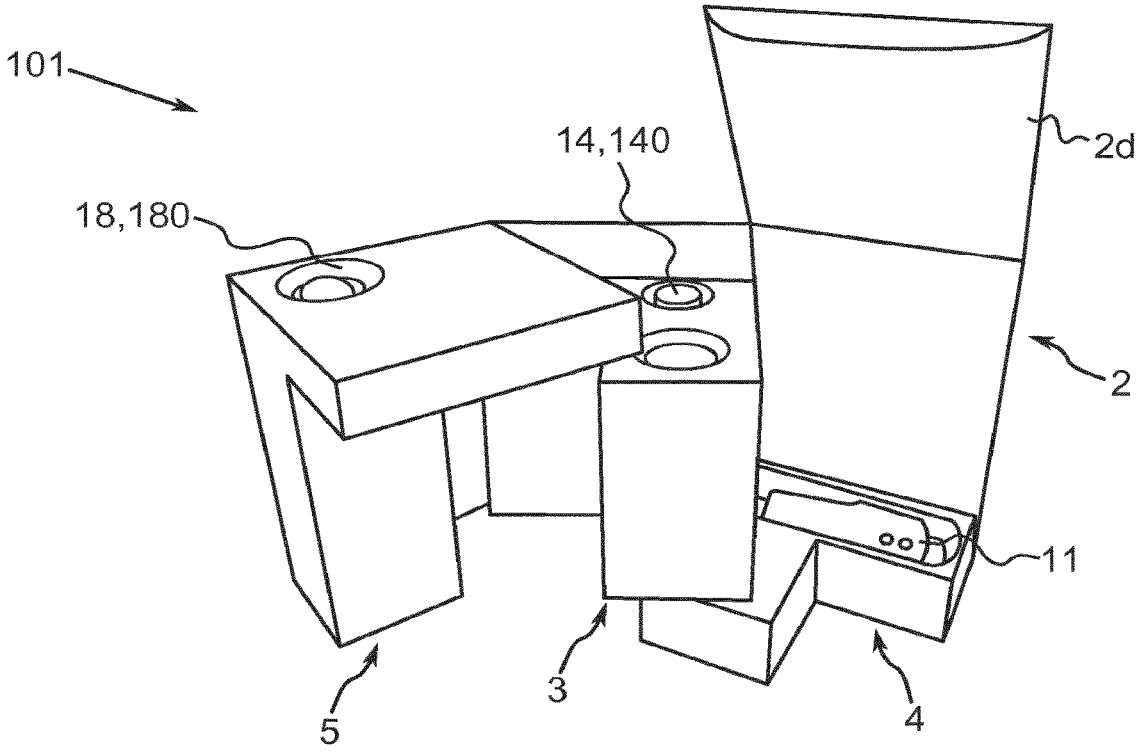
Figure 11:
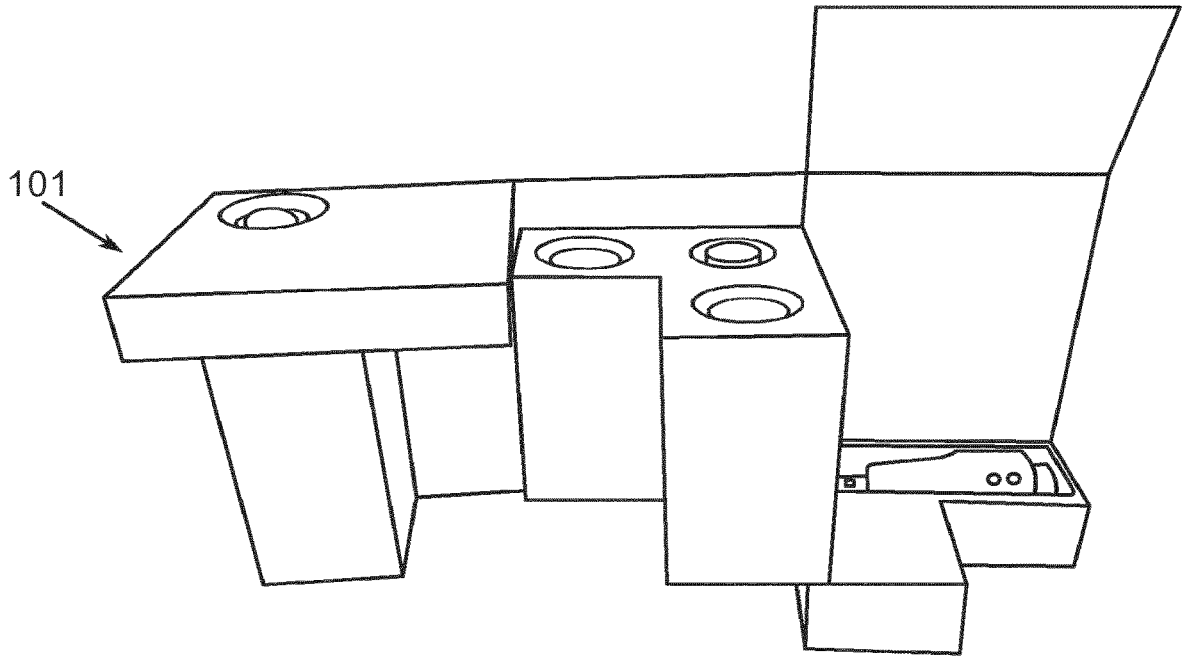

In FIGS. 9, 10 and 11, an exemplary packaging 101 according to an embodiment of the present invention is schematically illustrated in a perspective view, wherein the packaging 101 comprises a lid portion 2*d* which extends over the top surface 51' of the third packaging layer 5. The lid portion 2*d* is pivotable relative to the first back panel portion 2*a*, and adjustable between a first position and a second position. The top surface 51' is covered by the lid portion 2*d* when the lid portion 2*d* is in the second position. The packaging 101 is adapted to receive at least one third electronic smoking device product into the at least one third receptacle 5*a* when the lid portion 2*d* is in the first position. The third electronic smoking device product may be a battery 18, 180. In FIG. 9, the packaging 101 is shown in a closed position.

FIG. 10, shows the packaging 101 in a position between an open position and a closed position. In addition, at least one electronic smoking device product (e.g., charging device 11, atomizer/liquid reservoir portion 14, battery 18, 180) being inserted into the respective at least one receptacle 3*a*, 4*a*, 5*a* are illustrated.

In FIG. 11, the packaging 101 is shown in the open position. The receptacles 3*a*, 4*a*, 5*a* are accessible for removal of the electronic smoking device product (e.g., charging device 11, atomizer/liquid reservoir portion 14, battery 18, 180).

In summary, in one aspect the packaging for at least one electronic smoking device product comprises a back panel and at least two packaging layers, wherein the back panel comprises a first back panel portion and a second back panel portion, wherein the first and second back panel portions are pivotable relative to each other, wherein the at least two packaging layers comprise a first packaging layer and a second packaging layer, wherein the first packaging layer is connected to the first back panel portion, wherein the second packaging layer is connected to the second back panel portion.

The packaging may hereinafter also be called e-cigarette "cube pack" and may work on the basis of having various packaging layers which are supported by the back panel. Despite their individual shapes, the layers may be designed to fit together to form a perfect cuboid. In use, the back panel may be unfolded or opened in another way such that the layers may become separated and allow the consumer to access the components and accessories stored in each layer. A top layer may be adapted to house an e-cigarette battery, the middle layer may be adapted to house three cartomizers, and the lower layer may be adapted to house or store a Universal Serial Bus, USB, charger. The packaging may include other or further packaging layers, for example packaging layers for storing at least one of a wall adaptor, a leaflet, a carry-case and other accessories or components for an electronic smoking device. Thereby, a modular way to package e-cigarettes may be realized. One or more packaging layers may be exchangeable or reversibly connectable to the packaging.

The packaging may be adapted to store e-cigarette battery, all cartomizers and/or other electronic smoking device products in an upright position. This may prevent unwanted leakage and also enable consumers to directly assemble their e-cigarette from the pack, thus minimising contact with the components. That is, the packaging may be adapted to connect a first component of an electronic smoking device to a second component of the electronic smoking device while at least one of the first and second components are stored in the packaging. The packaging may provide a relatively new product/pack experience as well as an element of surprise and discovery upon use of the pack by a user.

The at least two packaging layers may assist with consumer communication by at least one of naming the packaging layers (for example "Cartomizer layer"), and using colour coding for different layers. Thus, it is made relatively easy, for a consumer new to the category, to identify different components or accessories.

The first packaging layer may be fixedly connected to the first back panel portion, wherein the second packaging layer may be fixedly connected to the second back panel portion.

The back panel may comprise a third back panel portion, wherein the third back panel portion may be pivotable relative to the first back panel portion, wherein the at least two packaging layers may comprise a third packaging layer being connected to the third pack panel portion, wherein the third packaging layer may be fixedly connected to the third back panel portion.

The packaging may be adapted to be adjustable between an open position and a closed position, wherein the packaging may be adapted to package the at least one electronic smoking device product by adjusting the packaging between the open and closed positions.

The at least two packaging layers may fit together when the packaging is in the closed position.

The packaging may have a cuboidal shape when the packaging is in the closed position.

The second packaging layer may be a bottom packaging layer of the packaging, wherein the third packaging layer may be a top packaging layer of the packaging, wherein the first packaging layer may be arranged between the second and third packaging layers when the packaging is in the closed position.

The packaging may further comprise at least one receptacle adapted to house the at least one electronic smoking device product, wherein the electronic smoking device product may comprise at least one of one or more electronic smoking device components and one or more accessories for an electronic smoking device portion.

The first packaging layer may comprise at least one first receptacle, wherein the packaging may be adapted to receive at least one first electronic smoking device product into the at least one first receptacle when the packaging is in the open position, wherein the at least one first receptacle may be covered by the third packaging layer when the packaging is in the closed position. The at least one first receptacle may have a longitudinal shape. The at least one first receptacle may have an insertion opening being arranged at the end of the at least one first receptacle. The insertion opening may face a bottom surface of the third packaging layer when the packaging is in the closed position.

The second packaging layer may comprise at least one second receptacle, wherein the packaging may be adapted to receive at least one second electronic smoking device product into the at least one second receptacle when the packaging is in the open position, wherein the at least one second receptacle may be covered by the first packaging layer when the packaging is in the closed position. The at least one second receptacle may have a longitudinal shape. The at least one second receptacle may have an insertion opening. The insertion opening may mainly extend between the two ends of the at least one second receptacle. The insertion opening of the at least one second receptacle may face a bottom surface of the first packaging layer when the packaging is in the closed position.

The back panel may comprise a lid portion extending over a top surface of the at least two packaging layers, wherein the lid portion may be pivotable relative to the first back panel portion, wherein the lid portion may be adjustable between a first position and a second position, wherein the top surface may be covered by the lid portion when the lid portion is in the second position.

The third packaging layer may comprise the top surface of the at least two packaging layers, and at least one third receptacle disposed in the top surface, wherein the packaging is adapted to receive at least one third electronic smoking device product into the at least one third receptacle when the lid portion is in the first position.

Unwanted access to the e-cigarette battery on the top packaging layer (for example in retail or transport) may be prevented by extending the back panel over the top surface of the pack for securing the battery.

In one aspect of the present invention, the system for packaging at least one electronic smoking device product comprises the at least one electronic smoking device product and a packaging according to an embodiment of the present invention, wherein the at least one electronic smoking device product fits into the packaging when the packaging is in a closed position.

The system may be provided as a starter kit containing different components and/or accessories. The system may have a modular nature, and may include one or more pack modules (packaging layers with an electronic smoking device component or accessory included therein). Thus, different pack modules may be packed in different locations before the pack modules are finally assembled onto the back panel in a central location to form the packaging. Thus, it may be possible for the manufacturer to prevent any duplication of work and potentially save packing costs.

The electronic smoking device may be an e-cigarette. The electronic smoking device may comprise a power supply portion adapted to receive a power supply, for example a battery. The atomizer/liquid reservoir portion may comprise a liquid reservoir, and an atomizer operable when connected to the battery to atomize liquid stored in the liquid reservoir. The power supply portion may be adapted such that the battery may be replaced or such that the battery may be recharged, via a charging module connected to the power supply portion, while the battery is positioned within the power supply portion.

The charging module may be an accessory for an electronic smoking device, wherein the charging module may be adapted to be connectable to the power supply portion to charge the battery housed by the power supply portion.

The atomizer/liquid reservoir portion may comprise a liquid reservoir, and an atomizer operable when connected to a power supply for an electronic smoking device to atomize liquid stored in the liquid reservoir. The atomizer/liquid reservoir portion may be reversibly attachable to the power supply portion.

While this invention has been described in connection with what is presently considered to be practical exemplary embodiments, it is to be understood that the invention is not limited to the disclosed embodiments, but, on the contrary, is intended to cover various modifications and equivalent arrangements included within the scope of the appended claims.

LIST OF REFERENCE SIGNS

1, 101 packaging
2 back panel
2*a* first back panel portion
2*b* second back panel portion
2*c* third back panel portion
2*d* lid portion
3 first packaging layer
3*a*, 3*a*', 3*a*" first receptacles
4 second packaging layer
4*a* second receptacle
5 third packaging layer
5*a* third receptacle
10 e-cigarette
11 charging device
11*a* plug
11*b* housing
11*c* coupling element
12, 120 power supply portion
14, 140 atomizer/liquid reservoir portion
16 end cap
18, 180 battery
20 light-emitting diode (LED)
22 control electronics
24 airflow sensor
26 atomizer
28 heating coil
30 wick
32 central passage
34 liquid reservoir
36 air inhalation port
38 air inlets

51 upper portion
51' top surface
52 lower portion

The invention claimed is:

1. A packaging for at least one electronic smoking device product, the packaging comprising:

a back panel comprising a first back panel portion and a second back panel portion and a third back panel portion, wherein the first and second back panel portions and the first and third back panel portions are pivotable relative to one another respectively; and a first packaging layer, a second packaging layer and a third packaging layer, wherein the first packaging layer is connected to the first back panel portion, the second packaging layer is connected to the second back panel portion and the third packaging layer is connected to the third back panel portion, and wherein the first and second packaging layers each include a respective first and second receptacle adapted to house an electronic smoking device product;

wherein the packaging is adapted to be adjustable between an open position and a closed position, and in the closed position, an insertion opening of the second receptacle faces a bottom surface of the first packaging layer and the first receptacle faces a bottom surface of the third packaging layer, and wherein the third packaging layer includes an upper portion and a lower portion, the upper portion extends over the first packaging layer when the packaging is in the closed position and the lower portion extends to a position that is lower than the bottom surface of the first packaging layer.

2. The packaging of claim 1, wherein the first packaging layer is fixedly connected to the first back panel portion, wherein the second packaging layer is fixedly connected to the second back panel portion.

3. The packaging of claim 1, wherein the packaging is adapted to package the at least one electronic smoking device product by adjusting the packaging between the open and closed positions.

4. The packaging of claim 1, wherein the first, second, and third packaging layers fit together when the packaging is in the closed position.

5. The packaging of claim 1, wherein the packaging has a cuboidal shape when the packaging is in the closed position.

6. The packaging of claim 1, wherein the second packaging layer is a bottom packaging layer of the packaging, wherein the third packaging layer is a top packaging layer of the packaging, and wherein the first packaging layer is arranged between the second and third packaging layers when the packaging is in the closed position.

7. The packaging of claim 1, wherein the respective first and second receptacle are adapted to house the electronic smoking device product that comprises at least one of an electronic smoking device component and an accessory for an electronic smoking device portion.

8. The packaging of claim 1, wherein the first receptacle is covered by the third packaging layer when the packaging is in the closed position.

9. The packaging of claim 1, wherein the first receptacle has a longitudinal shape and an insertion opening being arranged at an end of the first receptacle facing the bottom surface of the third packaging layer when the packaging is in the closed position.

10. The packaging of claim 1, wherein the second receptacle is covered by the first packaging layer when the packaging is in the closed position.

11. The packaging of claim 1, wherein the second receptacle has a longitudinal shape and the insertion opening extends between two ends of the second receptacle, wherein the insertion opening of the second receptacle faces the bottom surface of the first packaging layer when the packaging is in the closed position.

12. The packaging of claim 1, wherein the back panel comprises a lid portion extending over a top surface of the third packaging layer, the lid portion is pivotable relative to the first back panel portion and is adjustable between a first position and a second position, and wherein the top surface is covered by the lid portion when the lid portion is in the second position.

13. The packaging of claim 12, wherein the third packaging layer is the top packaging layer of the first, second, and third packaging layers, and a third receptacle is disposed in a top surface of the third packaging layer, and wherein the packaging is adapted to receive a third electronic smoking device product into the third receptacle when the lid portion is in the first position.

* * * * *